US005582708A

United States Patent [19]

Delfrate et al.

[11] Patent Number: 5,582,708

[45] Date of Patent: Dec. 10, 1996

[54] CELL AND PROCESS FOR CONTINUOUSLY ELECTROPLATING METAL ALLOYS

[75] Inventors: Franco Delfrate, Fameck; Claude Arnoux, Florange, both of France

[73] Assignee: Sollac, Putbeaux, France

[21] Appl. No.: 535,833

[22] Filed: Sep. 28, 1995

[30] Foreign Application Priority Data

Sep. 29, 1994 [FR] France ..... 94 11610

[51] Int. Cl.[6] ..... C25D 5/02; C25D 7/06; C25D 17/00

[52] U.S. Cl. ..... 205/129; 205/141; 204/206; 204/224 R; 204/269

[58] Field of Search ..... 205/138, 141; 204/206, 224 R, 211, DIG. 7, 129, 141, 269

[56] References Cited

U.S. PATENT DOCUMENTS

| | | | |
|---|---|---|---|
| 4,128,459 | 12/1978 | Bretts | 204/206 |
| 4,426,266 | 1/1984 | Ukena et al. | 204/DIG. 7 |
| 4,519,878 | 5/1985 | Hara et al. | 205/141 |
| 4,541,903 | 9/1985 | Kyono et al. | 205/141 |
| 4,784,740 | 11/1988 | Murakami et al. | 204/206 |
| 5,084,153 | 11/1992 | Mosse et al. | 204/DIG. 7 |
| 5,476,577 | 12/1995 | May et al. | 204/206 |

FOREIGN PATENT DOCUMENTS

| | | |
|---|---|---|
| 1331086 | 9/1973 | United Kingdom . |
| 2067223 | 7/1981 | United Kingdom . |

*Primary Examiner*—Donald R. Valentine
*Attorney, Agent, or Firm*—Sixbey, Friedman, Leedom & Ferguson, PC; Thomas W. Cole

[57] ABSTRACT

Electroplating cell comprising an electrolysis tank (2) containing a plating solution (S), at least one immersed anode (3), means for making a strip run through the solution (S) in front of said anode (3), from one of its edges (3A) to the opposite edge (3B), and electrically insulating masks (4A, 4B) arranged along said edges (3A, 3B).

Said masks overhang said edges by an amount at least equal to the distance separating said anode (3) from said strip and overlap them by an amount less than the same distance.

Application to coating with an alloy, especially a zinc-based alloy, especially in installations having several successive cells.

The quality of the coating is improved, something which facilitates the subsequent forming and painting of the coated sheet.

9 Claims, 2 Drawing Sheets

CELL AND PROCESS FOR CONTINUOUSLY ELECTROPLATING METAL ALLOYS

FIELD OF THE INVENTION

The invention relates to an electroplating cell for the continuous coating of metal strips with a layer of metal alloy.

In order to coat a metal strip with a layer of alloy, especially a steel sheet with a layer of zinc alloy, the strip is generally made to run through an installation which includes a succession of electroplating cells, each cell contributing to the formation of a portion of the layer, or "sublayer"; the stack of sublayers forms the layer of alloy.

PRIOR ART

In the processing or the use of a sheet continuously coated by electroplating with a layer of metal alloy, especially a sheet coated with a zinc alloy, a number of problems have been observed, especially during subsequent forming or after painting.

When pressing such a coated sheet, flaking-off or "shedding" of the coating is frequently observed, which causes clogging of the forming tools and a reduction in the protection provided to the sheet by the coating.

During some operations of forming said sheet, especially bending, disbondment of part of the coating is also occasionally observed especially by delamination within the actual thickness of the coating, or of the deposited layer.

Moreover, such a sheet coated with a layer of metal alloy by electroplating and then painted, especially by cataphoresis, does not exhibit sufficient resistance, especially for automobile applications, in the gravel-blasting test; the gravel-blasting test consists in spraying solid gravel particles onto the painted sheet and evaluating the resistance to gravel blasting, for example by counting the number of impacts on the sheet where the paint has been chipped off; after the gravel-blasting test on such a painted sheet, many flakes of paint are indeed observed and it is found that the chipping-off of the flakes of paint occurs in fact in the thickness of the electroplated coating or layer.

In order to avoid these problems when subsequently forming such sheets, it is possible to improve the lubrication of the forming tools.

In order to improve the gravel-blasting resistance of such painted sheets, it is possible to increase the thickness of the layer of paint.

Nevertheless, such solutions make the operations of forming and painting these sheets more complicated and more expensive.

SUMMARY OF THE INVENTION

The object of the invention is to improve the quality, especially the mechanical strength, of metal-alloy coatings continuously deposited on metal strips by electroplating.

The object of the invention is also to limit the aforementioned drawbacks relating to the forming and painting of the alloy-coated strips or metal sheets.

The subject of the invention is an electroplating cell for the continuous coating of a metal strip, especially with a layer of metal alloy, comprising an electrolysis tank containing a plating solution, at least one anode immersed in said solution and having an active surface delimited by edges, means for making the strip run through the solution in front of said active surface from one edge of said surface to another opposite edge of said surface, said means defining a strip running path, and means for making an electrical current pass between said anode and said running strip serving as cathode, characterized in that said active surface of each immersed anode is bordered on each of said two opposite edges by a mask having, along said corresponding edge and in front of said running path, an electrically insulating surface closer to said running path than said edge, said mask overhanging, towards the outside, said anode active surface by an amount termed the overhang, measured along the running direction, at least equal to the distance which separates said edge from said running path, and said mask overlapping the edge of said anode active surface by an amount termed the overlap, measured along the running direction, less than the distance which separates said edge from said running path.

The invention may also exhibit one or more of the following characteristics:

- the distance which separates each mask bordering an edge of the active surface of the anode from the strip running path is less than 0.5 times the distance which separates said edge from the strip running path,
- said mask is in the form of a plane panel constructed entirely from an electrically insulating material,
- said cell is of the radial type,
- said anodes are soluble and/or said plating solution is based on chloride anions.

The subject of the invention is also an electroplating installation for the continuous coating of a metal strip, especially with a layer of metal alloy, comprising a cascaded succession of cells according to the invention.

The subject of the invention is also the use of electroplating cells according to the invention for the continuous coating of metal strips with a layer of metal alloy.

In this case, the invention may also exhibit one or more of the following characteristics:

- said metal alloy is a zinc-based alloy,
- the zinc content by weight of said alloy is greater than 10%.

The subject of the invention is also a process for coating a metal strip by electroplating with a metal alloy, especially a zinc-based alloy, using an installation comprising several cells according to the invention arranged in cascade, in which process said strip is made to run successively through said cells of the installation and an electrical current is made to flow between the anodes of the cells and said running strip, characterized in that the running speed of said strip in the installation is greater than 50 m/minute and/or the density of the electrical current flowing between the anodes of the cells and said strip is greater than 50 A/dm$^2$.

BRIEF DESCRIPTION OF THE DRAWINGS

The invention will be better understood on reading the description which follows, given by way of example and with reference to the appended drawings in which.

DESCRIPTION OF THE PREFERRED EMBODIMENTS

The electroplating installation comprises several identical electroplating cells arranged in cascade.

Figure 1:
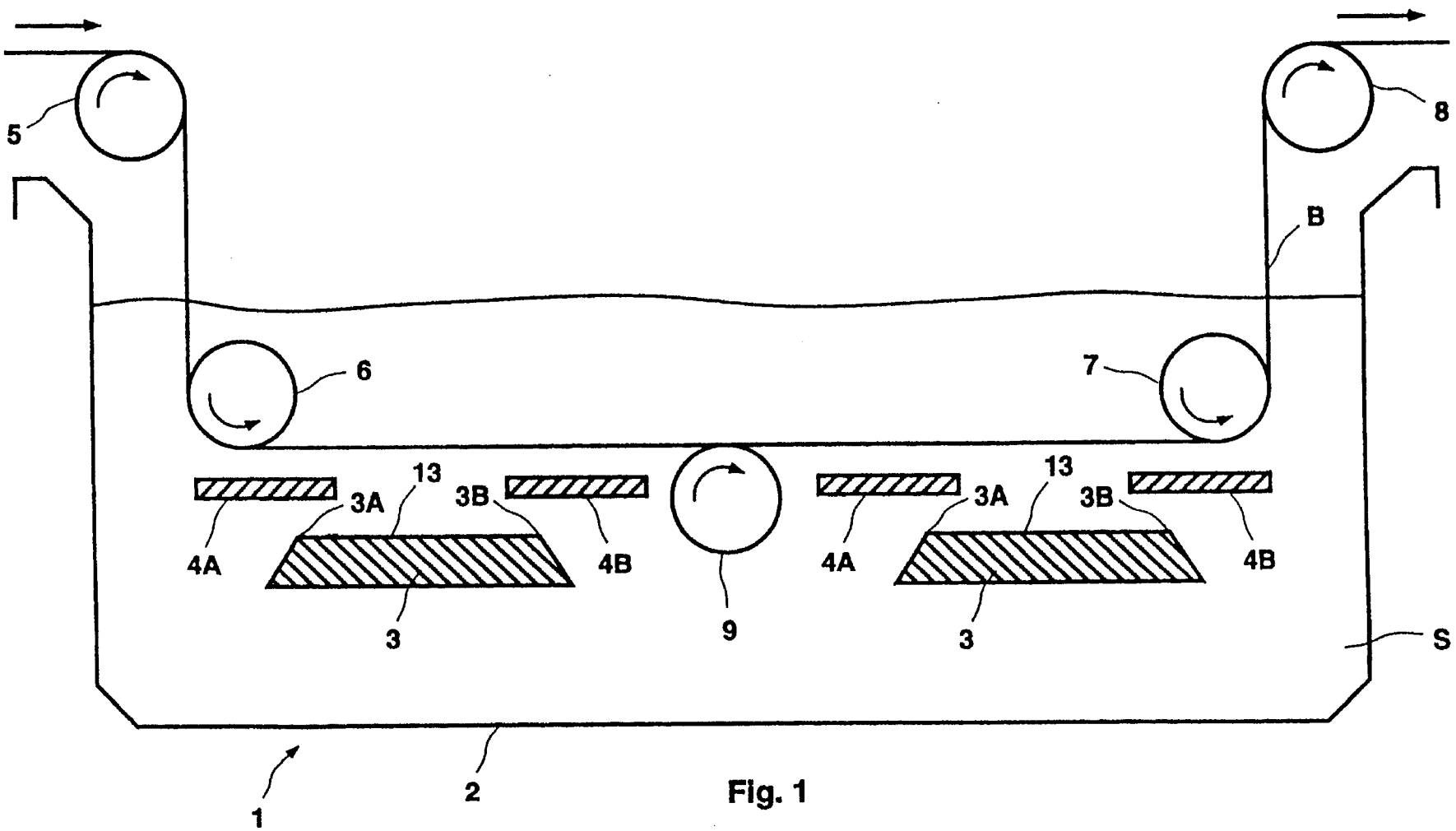
FIG. 1 is a sectional diagram of a plane electroplating cell according to the invention.

The first cell of the installation is depicted in FIG. 1, designated in its entirety by the reference 1, and comprises an electrolysis tank 2 containing a plating solution S, means for running a metal strip B through the solution S and defining a strip running path and two anodes 3 positioned successively below the strip running path and in front of it; the cell 1 also comprises means for the flow of an electrical current between said anodes 3 and the running strip B serving as cathode, these means not being depicted here.

Without departing from the present invention, the electroplating cell may include a single anode or more than two successive anodes.

The nature of the anodes and the nature, temperature and composition of the plating solution will be specified later in the explanation of the operation of the cell according to the invention.

The running means comprise strip support rollers having parallel axes, namely two strip input rollers 5, 6, two strip output rollers 7, 8 and an intermediate roller 9 for supporting the strip in the tank. On the input side as on the output side of the tank, one 6, 7 of the two rollers is immersed and the other 5, 8 is non-immersed, the intermediate roller 9 is immersed; the non-immersed rollers 5, 8 are conducting and are motorized in order to run the strip B.

The three rollers 6, 9, 7 immersed in the electrolysis tank define the strip running path in the electrolysis tank, which here is approximately in a horizontal plane.

The two anodes 3 are each positioned between two immersed rollers and each has a plane active surface 13 placed beneath the strip running path and oriented parallel to it and towards it.

The distance which separates the active surface 13 of the anodes 3 from the strip running path is generally between 0.5 and 10 cm in an industrial cell.

In a manner known per se and not described here, the active surfaces 13 of the anodes 3 extend transversely to the running direction over the entire width of the strip to be coated. Moreover, the active surfaces 13 of the anodes 3 extend along the strip running direction between two opposite edges 3A, 3B.

In the region of the edges 3A, 3B, the distance which separates the active surface 13 of the anodes 3 from the strip running path is commonly approximately 3 cm.

According to the invention, each anode 3 is bordered, along these two opposite edges 3A, 3B, by two masks 4A, 4B in the form of narrow plane panels.

Each panel-shaped mask 4A, 4B extends along one corresponding edge 3A, 3B of the active surface of the anode 3 and is arranged in a plane approximately parallel to the strip running path.

The masks are made from electrically insulating material, preferably a composite material or a plastic.

The masks 4A, 4B, each of which lies along an edge 3A, 3B of the anode active surface, are always closer to the strip running path than the anodes. Preferably, the distance which separates a mask 4A, 4B from the strip running path is less than 0.5 times the inter-electrode distance, that is to say that which separates the corresponding edge 3A, 3B from the same running path.

Without departing from the invention, the masks may take a form other than a narrow plane panel while at the same time presenting, in front of the running path and along one edge of the anode active surface, an electrically insulating masking surface closer to the running path than said edge.

The thickness of the masks 4A, 4B is preferably substantially less than said inter-electrode distance so that said masks may be partially inserted between the anode and the strip running path below the corresponding edge 3A, 3B of the anode active surface 13.

However, the thickness of the masks 4A, 4B is sufficient to ensure a function of electrical masking between the anode active surface 13 and the running strip serving as cathode.

Thus, the thickness of the masks is commonly of the order of 1 cm.

Preferably, each mask 4A, 4B, which lies along an edge 3A, 3B of the anode active surface, has an intersection which is continuous with the abstracted surface passing via said edge 3A, 3B and orthogonal to the strip running path.

The mask 4A, 4B, in the form of a narrow plane panel, extends widthwise on each side of said intersection, that is to say overlapping the corresponding edge 3A, 3B of the anode active surface on one side and significantly overhanging the other side, towards the outside, of said active surface.

The so-called amount of overlap, measured along the running direction, is less than the distance which separates said edge from said running path.

Thus, the amount of overlap of the mask 4A, 4B with respect to the corresponding edge 3A, 3B of the anode 3 is commonly less than 1 cm.

The amount of overhang of the mask 4A, 4B with respect to the corresponding edge 3A, 3B of the anode 3 is greater than or equal to the inter-electrode distance in the region of said edge.

According to the above description, each anode 3 is thus bordered by two masks 4A, 4B along two opposite edges 3A, 3B; according to a variant of the invention, two masks, which follow one immediately after the other along the strip running path and which flank two successive anodes, may be contiguous and form just a single plane panel. Thus, one and the same mask may serve to border two successive anodes.

The means for making an electrical current flow between the anodes 3 and the running strip serving as cathode comprise the two conducting non-immersed rollers 5, 8, which are known per se and are not described here in detail.

Figure 2:
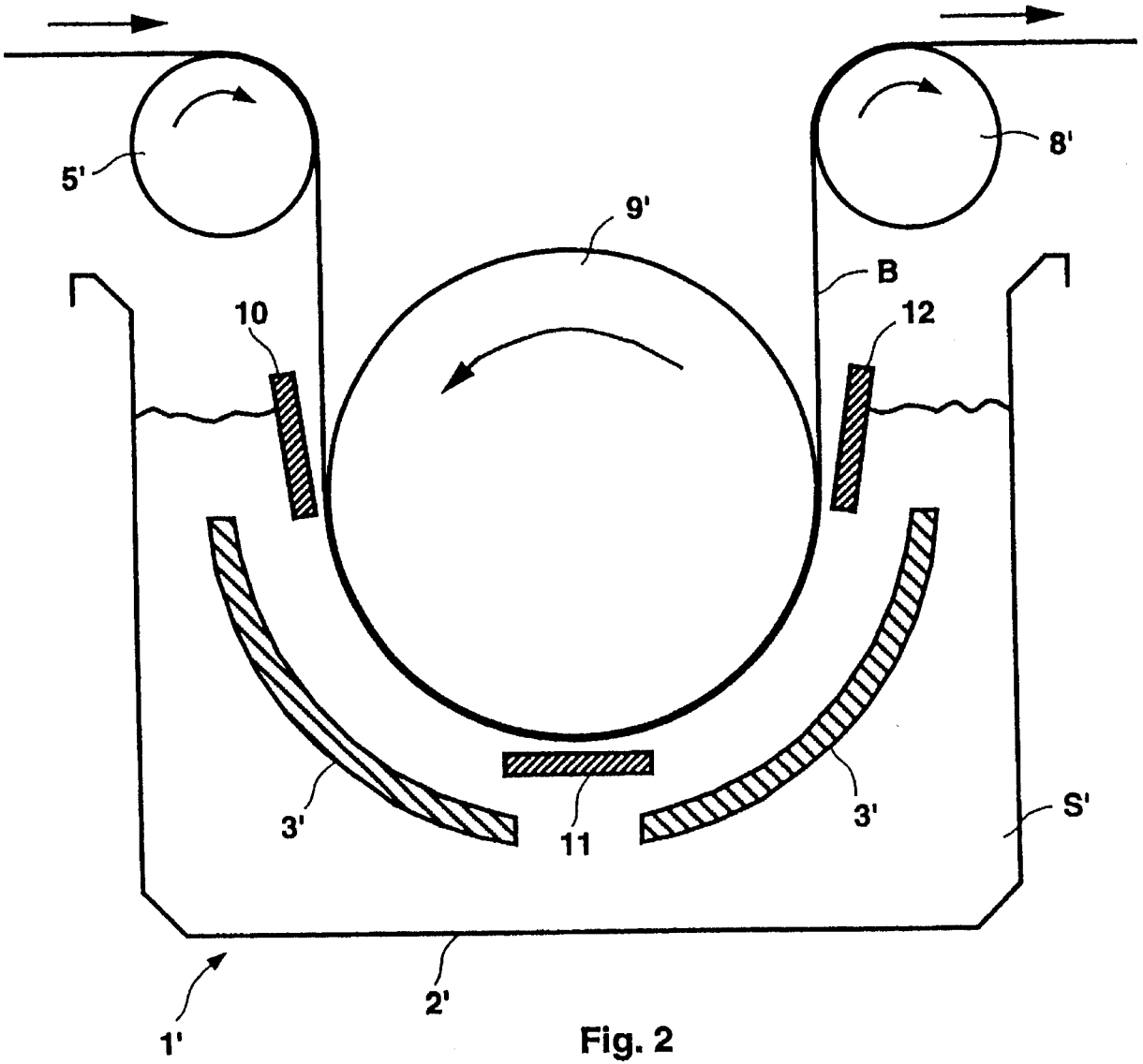
FIG. 2 is a sectional diagram of a radial electroplating cell according to the invention.

The invention applies to all geometries of electroplating cell, especially to radial cells; thus, FIG. 2 depicts a sectional diagram of a radial cell, designated in its entirety by the reference 1', comprising a tank 2' containing a plating solution S', strip running means comprising two conducting non-immersed rollers 5', 8' and a partially immersed roller 9', the surface of which defines the strip running path, two immersed anodes 3' in the form of circular arcs in front of the immersed part of said roller 9', and three masks 10, 11 and 12.

The first mask 10 lies in the region of the anode edge where the strip enters the solution and the third mask 12 lies in the region of the final anode edge where the strip leaves the solution.

In the particular configuration depicted in FIG. 2, the first and third masks may have a non-immersed part.

The second mask 11 is an intermediate mask which extends between the two anodes 3' and therefore simultaneously borders one of the edges of each anode 3'.

According to a variant of the invention, when the electroplating cell is provided with devices for injecting plating solution, in particular pipes having nozzles which are also positioned in the region of the anode edges and discharge into the gap separating the anodes from the strip running path, the masks may be supported by said pipes.

In the case where one of said pipes has a single nozzle extending over the entire width of the strip running solution, said nozzle may advantageously serve as a mask as long as it is electrically insulating and the masking surface which faces the strip running solution is not necessarily plane.

The operation of the electroplating installation, comprising a succession of electroplating cells 1 according to the invention, in order to coat a layer of zinc alloy on the surface of a steel strip B, will now be described.

Each cell of the installation contributes to the formation of a portion of the coating layer, or "sublayer" and the stack of sublayers forms the layer of alloy.

The cells 1 of the installation are provided with soluble anodes made of zinc.

The tanks 2 of the various cells 1 are filled with a plating solution S based on chloride anions and containing zinc cations and alloy elements in proportions and concentrations which are known per se in order to obtain said layer of alloy with the desired composition.

Preferably, said alloy elements are chosen from nickel, iron or cobalt.

Using the strip running means, the strip B is made to run successively through each of the cells of the installation.

Using the means for causing the electrical current to flow, an electrical current is made to pass between the anodes of the various cells and the steel strip B serving as cathode.

The strip running speed and the electrical current density of the various cells are adjusted in a manner known per se, in particular as a function of the thickness of the desired electroplating layer.

Preferably, the strip running speed is greater than 50 m/min.

Preferably, the current density is greater than 50 A/dm$^2$.

The steel strip B then leaves the installation coated with a layer of alloy.

The Applicant Company has surprisingly found that only very little flaking of the electroplated coating was observed when subsequently forming the coated steel strip, or the sheets cut out from the strip, in comparison with the flaking observed on sheets coated with alloy in a conventional manner.

Thus, flaking is limited, even for large deformations of the sheets coated according to the invention.

The Applicant Company has also surprisingly found that said strip when painted, especially by cataphoresis, withstood the gravel-blasting test much better than a sheet coated in a conventional manner with the same layer of alloy and painted in the same way.

According to a variant of the invention, the cells of the electroplating installation are equipped with insoluble electrodes and the tanks of the cells are filled with an electrolysis solution based on anions other than chloride ions, especially sulphate ions.

According to another variant of the invention, the electroplated layer is a metal alloy based on metals other than zinc, especially one based on tin and lead, or one based on iron and nickel, or one based on copper and nickel. The composition of the plating solution is adapted in a manner known per se to the type of alloy of the coating to be deposited.

The electroplating installation described hereinabove may be operated in order to coat steel strip or other metal strips, especially stainless steel strips.

Overall, the Applicant Company has observed that, by employing an installation comprising a succession of cells according to the invention in order to coat a metal strip, especially a steel strip, continuously with a layer of alloy, especially a zinc-based alloy, a coating having in its thickness a high degree of uniformity, especially compositional uniformity, and excellent mechanical properties, especially resistance to delamination, was advantageously obtained.

Without being tied to any one theory, the Applicant Company considers that the masks bordering the anodes of the electroplating cells of the installation cause an abrupt variation in the current density at the inlet and at the outlet of the various anodes of the installation, something which makes it possible to ensure plating under more uniform current density conditions, guaranteeing a constant alloy composition through the thickness of the layer.

The following examples illustrate the invention:

Test 1:

The object of this test is to produce a coating of zinc alloy on a steel strip in electroplating cells according to the invention.

The electroplating installation includes a succession of radial cells 1' according to the invention, of the type described previously and depicted in FIG. 2.

The partially immersed roller 9', which defines the strip running path in the cell, has a width of 2 m and a diameter of 2 m.

The two anodes 3' are made of zinc and are soluble. The mean distance separating the anodes from said roller 9' is 3 cm.

The three masks 10, 11 and 12 are arranged approximately 1 cm from said roller 9' and barely penetrate, to a depth of less than 1 cm, the gap which separates the anodes 3' from said roller 9'.

The three masks 10, 11, 12 which border the two anodes are plane polypropylene panels 2 m in length, approximately 20 cm in width and 1 cm in thickness.

The plating solution contains:

140 g/l of zinc ions, 16 g/l of nickel ions, 300 g/l of chloride ions.

The temperature of the solution is maintained at 57° C. and the pH of the solution is maintained at a value of approximately 4.5 by additions of hydrochloric acid.

The strip to be coated is made of steel, has a width of 1.5 m and a thickness of 1 mm.

The strip is made to run through the installation at a speed of 100 m/min and an electrical current of A/dm$^2$ is made to pass between the anodes and the strip. A strip coated on one face with a layer of zinc alloy containing 12% by weight of nickel and having a thickness of approximately 5 micrometers is obtained.

Test 2:

The object of this test is to indicate whether a sheet coated according to the invention with a layer of alloy can then be formed without risk of substantial degradation of its coating.

Starting from the same steel strip, three sheet blanks A, B, C, having the same dimensions and coated using three different processes with the same 4-micrometer thick layer of zinc/nickel alloy having 12% of nickel by weight, are produced.

The coating of the sheet blank A was produced in batch mode in a manner known per se by immersing and holding said sheet blank to be coated in an electroplating cell in front of an anode, without moving, and by making an electrical current pass between said anode and the sheet blank serving as cathode.

The sheet blank B is cut from a steel strip coated continuously according to the prior art, that is to say by running said strip through electroplating cells which are not provided with anode-edge masks.

The sheet blank C is cut from a steel strip coated continuously according to Test No. 1 above.

Next, the sheet blanks A, B, C are pressed under the same conditions and, after the pressing operation, the weight loss of each sheet blank, divided by the area of the coating, is measured. The result of the measurement is an indicator proportional to the flaking-off or "shedding" of the coating.

The following results of weight loss per unit area are obtained: blank A, 0.3 $g/m^2$; blank B, 1.1 $g/m^2$; blank C, 0.4 $g/m^2$.

Thus, the alloy coating produced continuously on a steel sheet in electroplating cells according to the invention exhibits excellent resistance to flaking-off or "shedding".

Test No. 3:

The object of this test is to indicate that a painted sheet, coated beforehand according to the invention with a layer of alloy, resists the gravel-blasting test particularly well.

In a manner known per se, each sheet blank A, B, C from Test No. 2 is painted by cataphoresis and under the same conditions. Conventionally, the thickness of the paint layer is approximately 100 micrometers.

Next, each sheet blank A, B, C is subjected to the same gravel-blasting test, which consists in spraying gravel particles for a predetermined time onto the sheet blanks to be tested.

Depending on the resistance of the coating, the gravel impacts on the painted sheet blanks A, B, C do or do not cause chipping off of the paint and of the coating.

In a manner known per se, the proportion of painted area which has been chipped off during the test is measured on a scale from 0 to 7, 0 meaning the absence of tearing and excellent gravel-blasting resistance and 7 meaning very high degree of chipping off and poor gravel-blasting resistance.

The results of the gravel-blasting resistance are as follows: blank A, 2; blank B, 4; blank C, 2.

By observing the points of impact, it is found that the chipping of paint from the blank B often involves, by delamination, part of the alloy layer whereas the chipping of paint from the blanks A and C does not generally involve the coating. This observation makes it possible to ascribe the better performance characteristics achieved on the blanks A and C to the alloy coating itself.

A very substantial improvement is therefore observed in the gravel-blasting resistance of painted sheets continuously coated beforehand with alloy according to the invention compared to that of sheets painted in the same way and continuously coated beforehand with the same layer of alloy, but in a conventional manner, especially by using electroplating cells that do not include masks.

We claim:

1. An electroplating cell for the continuous coating of a metal strip, especially with a layer of metal alloy, comprising an electrolysis tank for containing a plating solution, at least one anode adapted for immersion in said solution, and having an active surface delimited by edges, means for making the strip run through the solution in front of said active surface from one edge of said active surface to another opposite edge of the same surface, said means defining a strip running path, and means for making an electrical current pass between said anode and said running strip serving as cathode, wherein said active surface of each anode is bordered on each of said two opposite edges by a mask having, along said corresponding edge and in front of said running path, an electrically insulating surface closer to said running path than said edge said mask overhanging, towards the outside, said anode active surface by an amount of overhang measured along the running direction at least equal to the distance which separates said edge from said running path, and said mask overlapping the edge of said anode active surface by an amount termed the overlap measured along the running direction less than the distance which separates said edge from said running path.

2. The electroplating cell as claimed in claim 1, wherein the distance which separates each mask bordering an edge of the active surface of the anode from the strip running path is less than 0.5 times the distance which separates said edge from the strip running path.

3. The electroplating cell as claimed in claim 1, wherein said mask is in the form of a plane panel made from electrically insulating material.

4. The electroplating cell as claimed in claim 1, wherein the cell is of the radial type.

5. The electroplating cell as claimed in claim 1, wherein said anodes are soluble and/or in that said plating solution is based on chloride anions.

6. The electroplating installation for the continuous coating of a metal strip, especially with a layer of metal alloy, comprising a cascaded succession of cells as claimed in claim 1.

7. The electroplating cell as claimed in claim 1, wherein said electrolysis tank contains a plating solution that includes a zinc-based alloy, and two anodes.

8. The electroplating cell as claimed in claim 7, wherein the zinc content by weight of said alloy in said solution is greater than 10%, and said electrolysise tank also includes four masks.

9. A process for coating a metal strip by electroplating with a metal alloy, especially a zinc-based alloy, using an installation including several cells, arranged in cascade, comprising the step of running said strip successively through said cells of the installation while an electrical current is made to flow between the anodes of the cells and said running strip, wherein the running speed of said strip in the installation is greater than 50 m/minute and/or the density of the electrical current flowing between the anodes of the cells and said strip is greater than 50 $A/dm^2$, wherein each of said cells includes an electrolysis tank for containing a plating solution, at least one anode adapted for immersion in said solution and having an active surface delimited by edges, means for making the strip run through the solution in front of said active surface from one edge of said active surface to another opposite edge of the same surface, said means defining a strip running path, and means for making an electrical current pass between said anode and said running strip serving as a cathode, and wherein said active surface of each immersed anode is bordered on each of said two opposite edges by a mask having, along said corresponding edge, and in front of said running path, an electrically insulating surface closer to said running path than said edge.

* * * * *